US009074833B2

(12) United States Patent
Arrighi

(10) Patent No.: US 9,074,833 B2
(45) Date of Patent: Jul. 7, 2015

(54) PROTECTED EMBRASURE AND ARMOURED VEHICLE THEREOF

(75) Inventor: Paolo Arrighi, La Spezia (IT)

(73) Assignee: OTO Melara S.p.A., La Spezia (SP) (IT)

( * ) Notice: Subject to any disclaimer, the term of this patent is extended or adjusted under 35 U.S.C. 154(b) by 57 days.

(21) Appl. No.: 14/115,280

(22) PCT Filed: May 3, 2012

(86) PCT No.: PCT/IB2012/000870
§ 371 (c)(1),
(2), (4) Date: Feb. 3, 2014

(87) PCT Pub. No.: WO2013/050829
PCT Pub. Date: Apr. 11, 2013

(65) Prior Publication Data

US 2014/0137729 A1 May 22, 2014

(30) Foreign Application Priority Data

May 3, 2011 (IT) ..... TO2011A0388

(51) Int. Cl.
*F41H 5/20* (2006.01)
*F41H 5/18* (2006.01)
(Continued)

(52) U.S. Cl.
CPC ..... *F41A 23/24* (2013.01); *F41A 27/18* (2013.01); *F41H 5/013* (2013.01); *F41H 5/12* (2013.01); *F41H 5/16* (2013.01); *F41A 27/22* (2013.01);
(Continued)

(58) Field of Classification Search
CPC ..... F41A 23/24; F41A 27/22; F41A 27/24; F41A 27/18; F41H 5/00; F41H 5/18; F41H 5/20; F41H 5/12; F41H 5/16; F41H 5/013
USPC ..... 89/36.01, 36.03, 36.06, 36.07, 36.08, 89/36.09, 36.13, 36.14, 1.1, 901, 919, 928, 89/929, 930, 935
See application file for complete search history.

(56) References Cited

U.S. PATENT DOCUMENTS 373,623 A * 11/1887 Vavasseur ..... 89/37.01
4,617,852 A 10/1986 Allais et al.
(Continued)

FOREIGN PATENT DOCUMENTS

EP 0 844 455 5/1998
EP 1 508 765 2/2005

OTHER PUBLICATIONS

International Search Report for International Application No. PCT/IB2012/000870 mailed Aug. 20, 2012 (3 pages).

*Primary Examiner* — Jonathan C Weber
(74) *Attorney, Agent, or Firm* — Merchant & Gould P.C.

(57) ABSTRACT

A protected embrasure (1) includes a firearm (10) having a barrel or cradle (11). The protected embrasure (1) has a body (20) and zenithal angle device or elevation angle device (21) of the firearm (10), which cause the firearm (10) to rotate around a rotation axis X, which is orthogonal to a firearm axis Y, which is defined by the length of the barrel or cradle (11). The elevation angle device (21) causes the firearm (10) to rotate by an elevation angle ϕ with respect to a horizontal direction. The embrasure includes a pair of protection plates (30, 50) mounted above the firearm (10); and a third protection plate (31) mounted under the firearm (10). The plates are oriented with respective faces lying on a plane having an axis that is parallel to the rotation axis X and orthogonal to the firearm axis Y.

9 Claims, 4 Drawing Sheets

(51) Int. Cl.

| | |
|---|---|
| ***F41A 23/24*** | (2006.01) |
| ***F41A 27/18*** | (2006.01) |
| ***F41H 5/013*** | (2006.01) |
| ***F41H 5/12*** | (2006.01) |
| ***F41H 5/16*** | (2006.01) |
| ***F41A 27/22*** | (2006.01) |
| ***F41A 27/24*** | (2006.01) |

(52) U.S. Cl.
CPC *F41A 27/24* (2013.01); *F41H 5/18* (2013.01); *F41H 5/20* (2013.01)

(56) References Cited

U.S. PATENT DOCUMENTS

| | | | | |
|---|---|---|---|---|
| 7,051,637 | B2 * | 5/2006 | Clark et al. | 89/36.06 |
| 7,243,590 | B2 * | 7/2007 | McClellan et al. | 89/36.06 |
| 7,478,580 | B1 * | 1/2009 | Parimi et al. | 89/36.13 |
| 7,509,904 | B2 | 3/2009 | Plumier | |
| 7,934,445 | B2 * | 5/2011 | McClellan | 89/40.06 |
| 7,946,210 | B1 * | 5/2011 | Schneider et al. | 89/36.03 |
| 8,402,877 | B1 * | 3/2013 | Petrosillo et al. | 89/36.03 |
| 8,910,559 | B1 * | 12/2014 | Berman | 89/36.08 |
| 2007/0209501 | A1 | 9/2007 | Ko | |
| 2009/0120274 | A1 * | 5/2009 | Schneider et al. | 89/36.08 |
| 2010/0024634 | A1 * | 2/2010 | McClellan et al. | 89/36.03 |
| 2011/0126697 | A1 * | 6/2011 | Schneider et al. | 89/36.08 |
| 2011/0154981 | A1 * | 6/2011 | Schneider et al. | 89/36.08 |
| 2011/0197747 | A1 * | 8/2011 | Schneider et al. | 89/36.08 |
| 2014/0137729 | A1 * | 5/2014 | Arrighi | 89/36.14 |

* cited by examiner

PROTECTED EMBRASURE AND ARMOURED VEHICLE THEREOF

This application is a National Stage Application of PCT/IB2012/000870, filed 3 May 2012, which claims benefit of Serial No. TO2011A000388, filed 3 May 2011 in Italy and which applications are incorporated herein by reference. To the extent appropriate, a claim of priority is made to each of the above disclosed applications.

BACKGROUND

The present invention is relative to a protected embrasure for fighting vehicles and it is also relative to an armed fighting vehicle comprising a protected embrasure.

It is known that armed fighting vehicles comprise turrets provided with firearms, such as heavy-machine guns, cannons or howitzers, if necessary two-barreled or four-barreled, which are able to perform zenithal (or elevation) or azimuthal rotations, in order to hit one or more targets.

It is also known that, when the firearm is mounted in the turret, it can be subject to great changes of the elevation angle; in this way, the front part of the turret and, in particular, the part immediately adjacent to the barrel or carriage of the firearm itself are prone to be hit by ammunitions of the enemies .

Therefore, there is a high risk for the most sensitive parts of the firearm to be hit by the ammunitions of the enemies, thus allowing the ammunitions of the enemies to penetrate a sensitive area inside the turret itself, which usually is in direct communication with the rest of the armed fighting vehicle. As a consequence, the operators of the vehicle and, in particular, the so-called "crew manning the gun" are directly exposed to enemy fire or, anyway, are scarcely protected from it.

Protection plates are known, which form vehicles with armor platings against the enemy ammunitions, and which are arranged in a fixed manner immediately in front of the turret and surround the barrel of the cannon, of the heavy-machine gun or of the howitzer. Though, these protection plates are not suitable for firearms that lay upwards with high elevation angles and, even worse, present mechanical-structural constraints when laying downwards with elevation angles lower than zero (the zero angle corresponding to the horizontal shooting). Indeed, the turret might not be mounted in a position high enough with respect to the hull of the fighting vehicle to adopt a fixed plate and, at the same time, be able to lay at targets with a sufficient negative elevation angle.

SUMMARY

Therefore, the object of the present invention is to describe a protected turret, which does not present the drawbacks described above.

According to the present invention, a protected turret is provided.

The object of the present invention, furthermore, is to provide an armed fighting vehicle.

According to the present invention, an armed fighting vehicle is provided.

BRIEF DESCRIPTION OF THE DRAWINGS

The invention will now be described with reference to the accompanying drawings, which illustrate a non-limiting embodiment, wherein.

DETAILED DESCRIPTION

Figure 1:
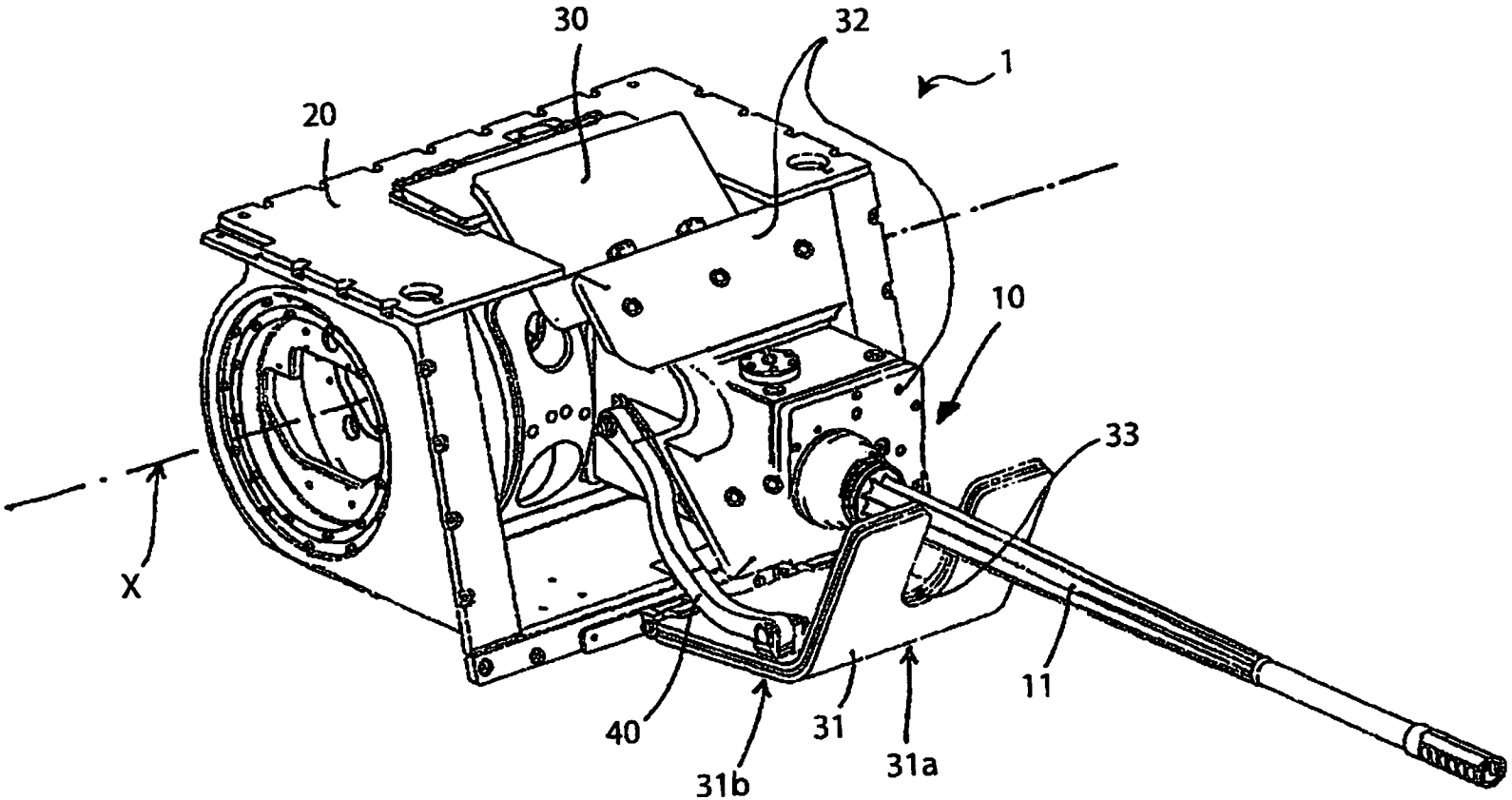
FIG. 1 shows a prospective view of a part of a protected turret according to the present invention.

With reference to FIG. 1, number 1 indicates a protected embrasure as a whole.

Protected embrasure 1 is adapted to be installed in turrets . of armed fighting vehicles and is provided with a firearm 10, such as for example an heavy-machine gun, a cannon or a howitzer, if necessary two-barreled or four-barreled, which is able to perform zenithal (or elevation angle $\phi$) or azimuthal rotations, in order to hit one or more targets.

The firearm of embrasure 1 presents its own axis, or firearm axis Y, which is defined by the length of its barrel or cradle 11, and, during the rotation for the variation of elevation angle $\phi$, rotates around a rotation axis X, which is orthogonal to firearm axis Y.

The embrasure presents a first protection plate 30, a second protection plate 50, a third protection plate 31 and a fourth protection plate 32, which are respectively mounted above, under and integral to firearm 10, which, at the front end of barrel or cradle 11, presents, as shown in FIG. 1, a muzzle brake.

The first and the third plate 30, 31 allow a protection of the rear part of firearm 10, in particular of the inside of embrasure 1 and of the turret itself, which, in correspondence to the joint with firearm 10, is typically unprotected or, anyway, vulnerable to the enemy fire with the consequent risk of allowing enemy ammunitions to easily penetrate the embrasure and/or the turret, thus damaging part of the system.

The first and the third plate 30, 31 are mounted so as to have the outer faces oriented on a plane having an axis that is parallel to rotation axis X and orthogonal to firearm axis Y; in other words, they face, with a flat surface, a front part of the firearm and are respectively oriented upwards and downwards.

In particular, the third protection plate 31 comprises a cavity 33 having a width that is larger than or equal to the diameter of barrel or cradle 11; therefore, the latter can be introduced into the plate itself, thus guaranteeing a protection of the area immediately surrounding the barrel against the shootings substantially coming from a direction defined by axis Y.

In this way, cavity 33 forms an aiming recess of firearm 10, which is adapted to house barrel 10 with values of elevation angle $\phi$ substantially equal to zero or lower than zero.

Therefore, the front part of turret 1, in correspondence to the joint with firearm 10, is protected also in case of enemy attacks coming from the below the firearm itself.

The part of the embrasure that is not protected due to the presence of the recess is protected by the fourth plate 32.

Protection plate 30 is rotatory constrained to carriage 20 of embrasure 1 and to firearm or cradle 10.

The third protection plate 31 is constrained to carriage 20 by means of a rotation arm 40, which allows it to rotate around an axis that is parallel to axis X and, therefore, to at least partially follow the rotation of barrel or cradle 10 around axis X.

In particular, rotation arm 40 is provided with a first end 40*a*, which is rotatory constrained to said firearm 10, and with a second end 40*b*, which is rotatory constrained to the second protection plate 31. Therefore, the third protection plate 31 comprises a first and a second portion 31*a*, 31*b*, which are arranged at an angle with respect to one another and are joined along a line that is parallel to said rotation axis X. The second portion 31*b* is rotatory constrained to body 20 of embrasure 1, while the first portion 31*a* comprises cavity 33.

Figure 2:
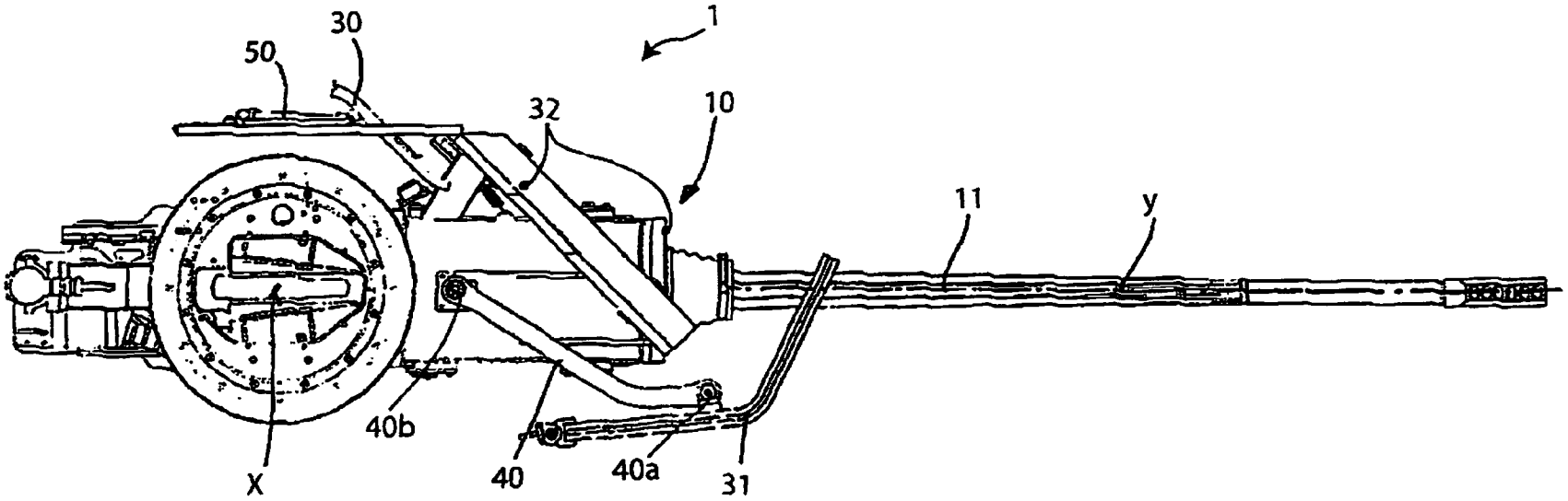
FIGS. 2, 3, and 4 show the part of the turret according to FIG. 1 in three different configurations.
Figure 3:
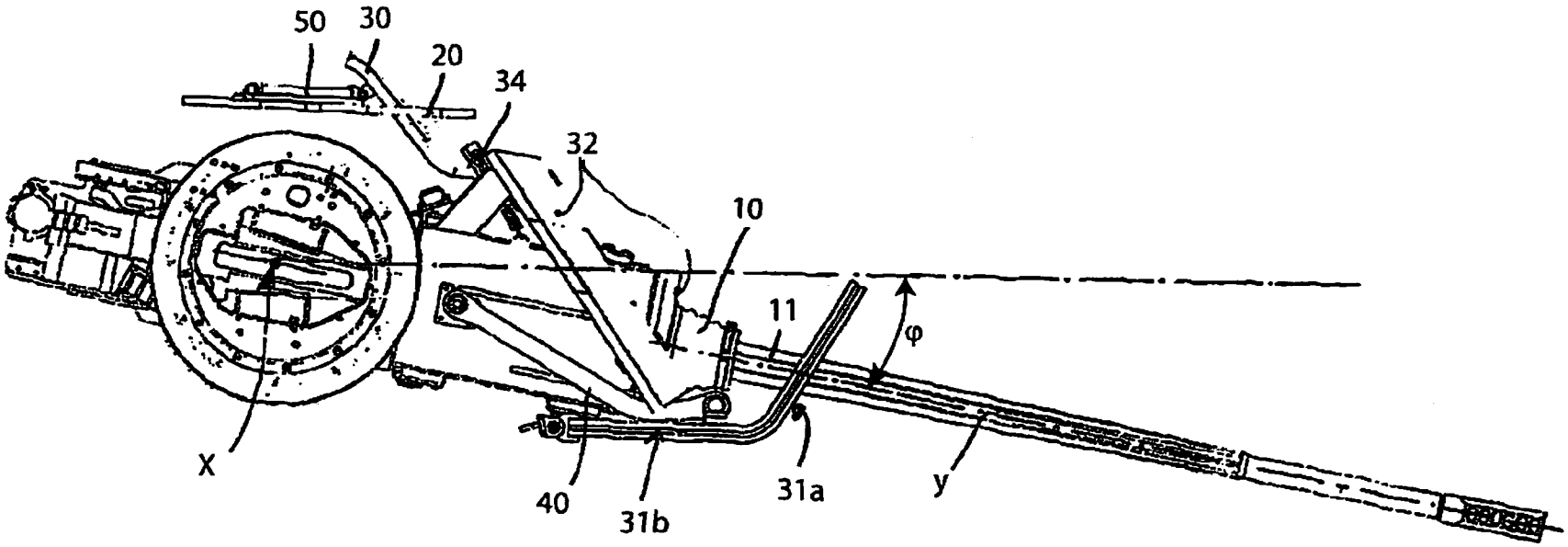
Figure 5:
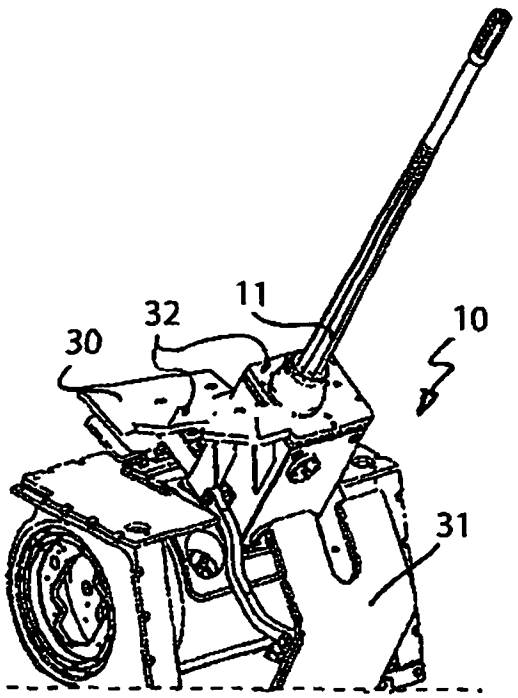
FIG. 5 shows a prospective view of the part of the turret according to FIG. 1.
Figure 4:
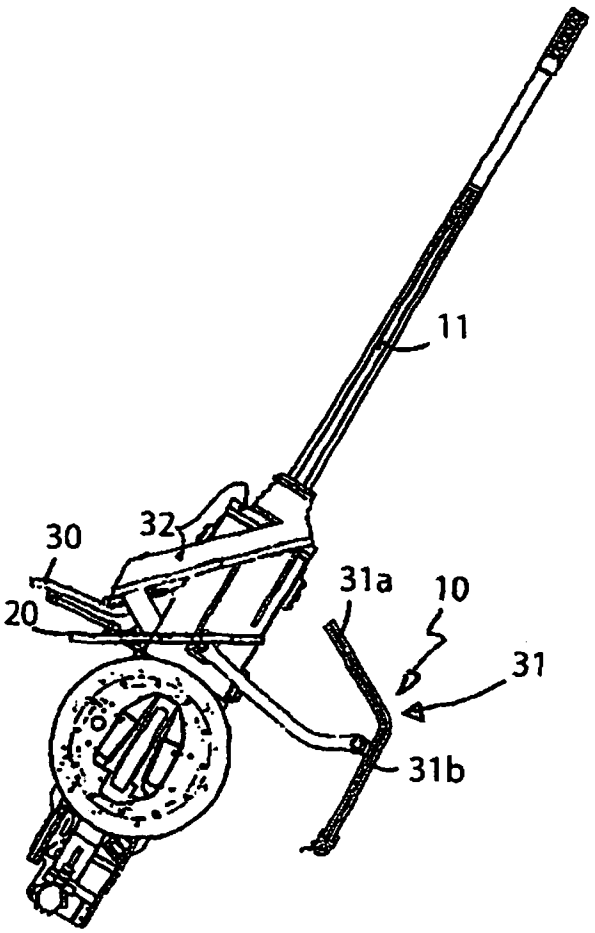

As shown in FIGS. 2, 3, and 4, the more firearm 10 moves downwards, thus with a negative elevation angle ϕ, the more the barrel or cradle of firearm 10 is introduced into recess 33; vice versa, the more firearm 10 is rotated to lift its barrel or cradle 11 with an elevation angle ϕ higher than zero, the more barrel or cradle 11 of firearm 10 comes out of recess 33 projecting upwards with respect to the latter.

During the rotation of barrel 11 upwards with positive values of elevation angle ϕ, rotation arm 40, furthermore, allows a protection of embrasure 1 and of the inside of turret 1 for elevation angles higher than zero. The mutual rotation movement of the barrel and of the third protection plate 31, which is constrained to embrasure 1 in correspondence to an end of the second plate 31*b*, causes a moderate lifting of the third protection plate 31 itself.

A further protection plate acting as a second rotation arm 50 is installed above the body of the embrasure; said second rotation arm 50 comprises a first and a second end, which are respectively constrained in a rotatory manner to the first protection plate 30 and to the embrasure itself. In this way, the second rotation arm 50 forms a rotation means for the first protection plate.

More in detail, the first end of the second rotation arm 50 is constrained to a first end of the first protection plate 30, which comprises, furthermore, a second end, which is constrained in a sliding manner to firearm 10 by means of straight guides 34, to which a respective retention spring is constrained.

The first plate 30, during its movement and rotation together with firearm 10, is introduced into a recess of carriage 20 of embrasure 10.

In this way, the first protection plate 30 rotates around an ideal mobile axis, which is parallel to axis Y, in a direction that corresponds to the direction of rotation of firearm 10 around axis X.

The advantages of the protected turret are known in the light of the previous description. In particular, it allows a mobile protection in a front area of the turret itself, in correspondence to firearm 10.

In this way, enemy ammunitions are prevented from easily entering and damaging the rear part of the firearm or the inside of the turret itself.

Furthermore, the two protection plates of the protected turret according to the present invention do not prevent the firearm from reaching high elevation angles, both positive and negative, and, thus, are adapted to be implemented in those situations in which the firearm has to hit objects below its level.

The turret described above can be subject to variations, additions and changes that are obvious to a skilled person, without in this way going beyond the scope of protection provided by the accompanying claims.

The invention claimed is:

1. A protected embrasure comprising a firearm having a barrel or cradle, and at least one firing chamber; a body and zenithal angle varying means or elevation angle varying means of said firearm, which cause said firearm to rotate around a rotation axis, which is orthogonal to a firearm axis, which is defined by the length of said barrel or cradle; said elevation angle varying means causing said firearm to rotate by an elevation angle with respect to a zero value corresponding to a horizontal direction;

a pair of protection plates, which are mounted above said firearm;

a third protection plate mounted under said firearm;

said plates being oriented with respective faces lying on a plane having an axis that is parallel to said rotation axis and orthogonal to said firearm axis;

said third protection plate comprises a cavity having a width that is larger than or equal to the diameter of the barrel or cradle;

said third protection plate comprises a first portion and a second portion, which are arranged at an angle with respect to one another and are joined along a line that is parallel to said rotation axis;

wherein said second portion is rotatory constrained to said body of said barrel or said cradle.

2. The protected embrasure according to claim 1, wherein said cavity forms an aiming recess of said firearm with values of the elevation angle lower than zero.

3. The protected embrasure according to claim 2, wherein said first portion includes said cavity.

4. The protected embrasure according to claim 1 comprising a first rotation arm; said first rotation arm causing said third protection plate to rotate and having:

a first end, which is rotatory constrained to said firearm;

a second end, which is rotatory constrained to said third protection plate.

5. Embrasure according to claim 4, wherein said first rotation arm forms rotation means of the third protection plate and protection means of said embrasure chamber and of said turret for the elevation angle being higher than zero.

6. The protected embrasure according to claim 1, wherein said first protection plate is installed on a second rotation arm comprising a second protection plate having a first end, which is rotatory constrained to said first protection plate, and a second end, which is rotatory constrained to the body of said protected embrasure.

7. The protected embrasure according to claim 6, wherein said second rotation arm is constrained to a first end of said first protection plate, and wherein a second end of the first protection plate is constrained to said firearm in a sliding and rotatory manner; said first protection plate rotating around an ideal axis, which is mobile and parallel to said rotation axis, when said firearm rotates around said rotation axis.

8. The protected turret according to claim 1, further comprising a fourth protection plate, which is constrained in an integral manner to said firearm and is mounted in a rear position with respect to the third protection plate.

9. Armed fighting vehicle comprising a turret with a protected embrasure according to claim 1; said protected embrasure being adapted to allow said firearm to rotate around the rotation axis for a variation of said elevation angle and around an azimuthal axis for variation of an azimuthal angle relative to aiming of said firearm.

* * * * *